US005180012A

United States Patent [19]

Crawford

[11] Patent Number: 5,180,012

[45] Date of Patent: Jan. 19, 1993

[54] METHOD FOR CARRYING TOOL ON COIL TUBING WITH SHIFTING SUB

[76] Inventor: James B. Crawford, P.O. Box 30636, Lafayette, La. 70503

[21] Appl. No.: 710,083

[22] Filed: Jun. 4, 1991

Related U.S. Application Data

[62] Division of Ser. No. 404,626, Sep. 7, 1989, Pat. No. 5,029,642.

[51] Int. Cl.[5] ..... E21B 19/22; E21B 31/113

[52] U.S. Cl. ..... 166/301; 166/381; 166/383; 166/384; 166/386

[58] Field of Search ..... 166/385, 381, 383, 386, 166/380, 379, 378, 384, 77, 301, 72, 178, 297

[56] References Cited

U.S. PATENT DOCUMENTS

| | | | |
|---|---|---|---|
| 3,313,346 | 4/1967 | Cross | 166/77 |
| 3,363,880 | 1/1968 | Blagg | 166/77 X |
| 3,401,749 | 9/1968 | Daniel | 166/384 |
| 3,722,594 | 3/1973 | Smith et al. | 166/307 X |
| 3,791,447 | 2/1974 | Smith et al. | 166/384 X |
| 3,827,487 | 8/1974 | Jackson et al. | 166/77 |
| 3,946,819 | 3/1976 | Hipp | 175/296 |
| 4,467,471 | 7/1984 | Hipp | 175/296 |
| 4,612,984 | 9/1986 | Crawford | 166/77 |
| 4,682,657 | 7/1987 | Crawford | 166/77 X |
| 4,844,166 | 7/1989 | Going, III et al. | 166/379 |
| 4,862,958 | 9/1989 | Pringle | 166/385 X |
| 4,928,770 | 5/1990 | Murray | 166/385 |
| 5,029,642 | 7/1991 | Crawford | 166/72 |

*Primary Examiner*—Hoang C. Dang

*Attorney, Agent, or Firm*—Pravel, Gambrell, Hewitt, Kimball & Krieger

[57] ABSTRACT

An invention relating to method and apparatus for the running of various tools and devices used to service oil and gas wells in combination with coiled tubing units that permits the application of a sudden downward force of predetermined magnitude.

15 Claims, 7 Drawing Sheets

METHOD FOR CARRYING TOOL ON COIL TUBING WITH SHIFTING SUB

This is a division of copending application Ser. No. 07/404,626 filed Sep. 7, 1989 now U.S. Pat. No. 5,029,642.

BACKGROUND OF THE INVENTION

The present invention relates to coiled tubing units and an improved method and apparatus and carrying tool for the running of various tools off of coil tubing which require the application of a sudden downward force. Various devices are used to service oil and gas wells. Service applications can include running and pulling of safety valves, pack off assemblies and gas lift valves, the running of mechanical and electrically operated plugs in the well and setting them to repair or remove well head or surface equipment, or for any other reason, for example washing sand and debris off wireline tools, opening and closing sliding side doors, cutting paraffin, isolating tubing segments and repairing and testing tubing and setting through tubing bridge plugs Presently some of the above mentioned applications are performed by coil tubing units, and others by solid wireline equipment. Although a few applications can be performed by both, many advantages can be realized by using coil tubing units. For instance, the solid wireline units, in many cases, cannot be used to service a well. A wireline tool, which is suspended from the wireline, cannot be lowered down the well hole where there is an accumulation of debris or sand or deviation of a hole; one additional example is horizontal well completion. It should be understood that any reference to a downward force herein means downward relative to the "top" of a carrying tool attached to coil tubing, and therefore the "downward" force may actually be a horizontal shifting force rather than vertically downward.

A wireline does not have the strength of the coil tubing unit which might be necessary to pull a given device from the well. In these cases a work over unit or snubbing unit must be used to rectify the problem. Work over units or snubbing units are expensive solutions, and require extra men and equipment on standby.

Blagg U.S. Pat. No. 3,363,880 describes a representative cable feeding apparatus, such as that used in the coil tubing unit services. Daniel U.S. Pat. No. 3,401,749 describes a representative wireline apparatus. Crawford U.S. Pat. No(s). 4,612,984, and 4,682,657, are illustrative of the many advantages of coil tubing units as compared to wireline units. The four mentioned Patents are hereby fully incorporated by reference.

As set out in the above referenced Patents, coil tubing units when provided with the proper carrying tools to run hollowed tools with internal flow bores into the well can perform several desirable functions such as washing debris and sand from the well to the "fishing neck", or "stuck" wireline tools; allowing continuous circulation while jarring or pulling wireline type apparatus; and allowing continuous circulation, and thus equalized pressure when removing safety valves from the well (such as surface-controlled wireline retrievable tubing safety valves; for example, Otis Model DS, DK, DR "storm chokes" and equivalents). Fishing necks on such valves or tools can be grabbed with an off/on overshot, or releasable spear, such as manufactured by Baker Oil Tools. These tools may be hollowed with an internal bore to allow for circulation when used with the coil tubing units, as will be covered in more detail later.

During the removal of safety valves that are "stuck", the coil tubing unit can provide a much greater pulling capacity than a wireline saving the use of the much more expensive standby work-over rig snubbing unit necessary in the event the wireline unit cannot retrieve a stuck valve. Because of the possibility that a wireline could not retrieve a "stuck" valve (or any other tool), a snubbing unit or work over and standby workover crew and equipment is required for safety reasons when working off of a wireline to install and remove safety valves.

The Crawford U.S. Pat. No(s). 4,612,984, and 4,682,657 describe a method and apparatus to enable the running of jars, running tools and all pulling tools off of a coil tubing unit. During servicing operations on a well it may be desirable to install a variety of subsurface controls, for example, tubing safety valves, bottom hole regulators, packing devices, bridge plugs, and bottom hole chokes (here listed for illustration and not limitation). There are a variety of companies that provide such equipment. In general, the equipment is installed into the tubing by properly locating the device as follows. The device is configured into a certain external profile to correspond with an internal profile or landing in a nipple in the tubing string. The device is then run down the tubing string, until the profiles match, which precisely locates the device, after which it is installed. The common method for installing such safety valves comprises locating the device correctly and applying a directed force, either up or down depending upon the type of device, which releases a spring-loaded mechanism or equivalent in or on the device or tool, which further locates and locks the tool by expanding locking elements or dogs into corresponding concavities provided as part of the internal profile within the landing nipple. Additional impacts on the tool further expand a sealing element, and fully lock the device into place. Next a force is applied in the opposite direction from that required to set the device, to shear a pin and release the device from the wireline or tubing unit which can then be removed from the hole leaving the safety valve in position.

Although the earlier referenced Crawford Patents refer to jarring tools that can be run with a coil tubing unit, until the present invention it was not possible to apply a sudden downward force with a coil tubing unit. As can be readily understood by a study of the Blagg reference, the common method of forcing the tubing down the wellhead does not allow impulsive sudden application of downward force.

Generally, there are two types of devices or equipment installed in wells referred to in the industry as "X" equipment and "S" equipment. X equipment requires a downward force to locate and seat the device and an X device releases from the tubing string and carrying tool, or from the wireline, upon the application of force in the upward direction. S equipment, in contrast, requires upward force to locate and lock the device and the device releases from the setting tool upon the application of a force in a downward direction. Generally removal of X equipment requires application of a downward force, S equipment conversely requires application of an upward force. Because a coil tubing string cannot be suddenly moved through the injector head of a coil tubing feeding unit prior to the present invention it was impossible to install X type equipment with a coil tubing unit because it was not possible to generate enough force in the downward direction to release the device. However, because of the relatively much higher tensile forces that can be applied through a coil tubing unit, relative to a wireline unit, coil tubing units are able to generate enough force in the upward direction to shear pins and release the tool. Therefore, although the method and apparatus of the referenced Crawford Patents allows application of a force in the upward direction, a sudden downward force or force sufficient to release X-type equipment and other downward force operated equipment is almost impossible to apply with coil tubing units primarily because of the drive mechanism and in some cases because of low weight of tubing above the valve, especially if the valve or other device is set in the nipple closest to the surface as is the usual case for safety valves.

The safety valve installation problem is illustrative of a problem existing during service operations on a well due to the need to have both a wireline unit and a coil tubing unit on standby, or to have both a wireline unit and a work-over unit on standby. The safety valve must be set at the end of each series of operations, for example, at the end of each day, or any time the service tools are pulled out of the well. The hole cannot be left in an open position, due to the danger of blow out and fire. The safety valve is in essence a stopper which must be put in and out in order to lessen the possibilities of a blow out. The present invention solves the problem by providing an apparatus, here named a shifting sub, which allows the application of a controlled and sudden downward force by a subsurface tool (or sub) which is run on a coil tubing unit. The force is sufficient to release the safety valve (or other device) from the coil tubing string, or to set equipment that requires downward force to set.

An additional example of downhole operations wherein the present invention presents great improvements is in the setting of plugs. Plugs are set to cement off or block off lower portions of a hole, in the case of closing a hole and abandoning it completely, or perhaps in the case of closing off the lower portion of a hole so that an upper formation can be worked. A plug is run in hole encased in a steel setting sleeve. A setting impulse is actuated which releases the plug from the sleeve and expands a basket. Steel slips will then hold the set plug in place while bridging material is run through the interior of the coil tubing unit. This bridging material includes, in most cases, lead shot for placement next to the basket of the plug and then a predetermined volume of cement. The present invention presents numerous advantages over the units run on wireline equipment, particularly because the cement dump bucket used with wireline equipment can carry only a very small volume of cement so that numerous runs are necessary to supply the needed volume of cement to plug a hole. When a plug is run on a coil tubing unit the volume of cement required is simply pumped through the coil tubing in one single continuous and much quicker operation. In effect, the contrast between a wireline cement dump bucket and the volume achievable through the coil tubing unit is like comparing a teaspoon to a dump truck.

Another application of the present invention would be for any operation that requires a detonation, for instance running a perforating gun sub. In general the way this is done now is that an actual explosive charge is set off which, in the manner of a detonator, sets off further shots perforating the steel casing to allow for production from a particular formation. The shifting sub of the present invention can replace the need for sending explosives down the well to act as the detonator. The present invention can simply be actuated by hydraulics to act as a firing pin or trigger to set off conventional perforating equipment.

Even though wireline equipment can be used to set safety valves and other equipment downhole, the process is a trial and error process with the setting tool (for example, Spang jar) attached to the wireline equipment simply lifted and dropped, lifted and dropped, et seq. until the device is released, and similarly lifted and dropped in order to set the safety valve. The operator has no precise control over the downward force being applied downhole, and in some instances the safety valve actually is not set correctly and can be blown out of the hole, unlike the controlled and directed precise force resulting from the apparatus and method of the present invention, which will be described in more detail below. In addition, a shifting sub constructed in this method can easily be removed from the hole and overhauled or modified to change the stroke or shearing force, unlike anything else in the art which has to be completely disassembled and overhauled to vary stroke or impact. Examples of other devices used in the field which must be disassembled for modification are those manufactured by Hipp which use a combination of hydraulics and preset and preloaded interior springs to provide a "jar" of indeterminate strength and stroke. These devices are described in U.S. Pat. No(s). 3,946,819 and 4,467,471.

A particular problem with retrieval of safety valves by wireline equipment is that the safety valves are of a larger diameter than the wireline equipment. When the wireline equipment is connected to a safety valve and the safety valve is pulled up the hole paraffin is trapped and builds up above the safety valve. The build of paraffin will cause the safety valve to become stuck, or at least can reach a magnitude greater than that possible to lift with a wireline. A safety valve attached to a coil tubing unit can simply be pulled up through the paraffin because of the much greater tensile stress a coil tubing unit can achieve.

One final example of the great benefit provided by the present invention is again related to the use of safety valves. As has been mentioned and will be mentioned in greater detail below, the many capabilities of a coil tubing unit, with provisions for adaptability and connection to any type of sub desired, has resulted in the use of coil tubing units on well sites, if for no other reason, because there are simply some things that cannot be done with a wireline unit. Safety considerations are paramount, and it is highly desirable to keep a safety valve installed in the well any time work is being done over the hole. Prior to the invention of the present apparatus and method, if the safety valve was of the type that could not be removed by a coil tubing unit the procedure that was followed was to have a wireline unit remove the safety valve and then have the coil tubing unit rig up over an open hole without the safety valve in place. The method and apparatus of the present invention provides a means of doing without the wireline unit altogether, rigging up over the hole with the coil tubing unit and shifting sub of the present invention, going downhole, removing the safety, pulling the safety valve completely out of the hole, removing it from the end of the coil tubing unit and the shifting sub, and then attaching the sub or downhole implement desired, and moving downhole with that instrument attached to the coil tubing unit to continue operations. This is a tremendous advance in safety due to the fact that the time spent working over an open hole without a safety valve in place is greatly reduced.

GENERAL DISCUSSION OF THE PRESENT INVENTION

The present invention provides a method and apparatus for pulling or running hollowed internal bore equipment or tools that are typically run on coil tubing units or wireline units, which further require the application of a downward force or impulse, either to set the equipment in place within a well bore, or to remove the equipment from the well bore. The method of the present invention includes the use of an elongated small diameter tubing string, which is stored on a reel in a coil. The lower distal end portion of the coil tubing forms a connection with a fluid conveying tool carrier, which is mounted on the distal end portion of the coil tubing string, so that fluid can circulate from the coil tubing on the reel through the coil tubing which is extended into the well bore and then into the tool carrier. The method further includes the use of a tool, a shifting sub, mounted on the tool carrier (first occurrence) which is adapted, as will be set out below, so as to allow generation of sudden forceful downward movement of the lower portion of the tool, or shifting sub in response to a selected level of pressure build up within the shifting sub. Pressurized fluid can be introduced into the well through the coil tubing and then through the tool carrier, and selectively, through the tool itself. In this manner the gas or fluid can circulate into the well through any tool used to pull or run wireline equipment including but not limited to wireline tools although such wireline tools might require modification to provide an internal bore or fluid passage for use with the shifting sub of the present invention. Tensile forces can be applied to equipment within the well through the coil tubing string that far exceeds the tension that can be applied with a wireline and, in addition, a much more precise and controlled application of a sudden downward force or impulse can be applied than with conventional wireline equipment.

In another embodiment, the shifting sub would be mounted within a carrier such as described in Crawford U.S. Pat. No(s). 4,612,984 and 4,682,657, for attachment to a string of coil tubing. In further combination this embodiment would comprise a setting, pulling, running, or fishing tool which further can be provided with an internal bore allowing fluid circulation through the bore, and through the tool carrier. Illustrative examples of tools and equipment in combination with the shifting sub of the present invention would be: fishing tools such as spears, overshots, wireline like setting tools such as locating and locking mandrels; and other running tools for setting or removing various other down hole flow control devices such as screens, perforating guns, packers and valves, plugs or plug choker assemblies of various types. Other examples would include electric line plugs or packers possibly modified for use with the present invention which would require the use of a detonator or detonating device as previously mentioned. Examples of these would be numerous types of conventional perforating guns which are used for perforating pipe for production.

The shifting sub combination described, preferably at least for some applications, would include mechanical or other means operable by tension or compression applied through the coil tubing string and, in addition, would include mechanical means actuated by fluid or hydraulic pressure, so that the tool could form a connection to an object within the well, or so that the tool could be used to insert or release equipment, such as a safety valve, plugs or other wireline type equipment into the well.

For example, the coil tubing string with the tool carrier, and tool of the present invention, could be thrust into the well by an injection head with pipe feed and rotation of the reel. The combination tool could be the shifting sub with an attached locating and locking mandrel to which is attached a safety valve. Installation of the safety valve within the well would be carried out by correctly positioning the safety valve within the well, pulling up to set the valve and then actuating the shifting sub by the application of a pre-selected pressure build up within the internal bore of the shifting sub to release the sub and mandrel allowing removal the tubing string while leaving the safety valve in the well.

The described method allows installation and removal of safety valves, and use of other manner of tools and equipment within the well, that require application of a downward force either to set or release or detonate the equipment into or from the well bore. The method allows the pumping of pressurized fluid through the coil tubing unit to and through the carrying tool, and to and selectively through the shifting sub tool, and through any other hollowed wireline tool, which is attached or included to aid in moving the combination through any material which might be accumulated in the well. Circulation of fluid solves a problem, mainly sand accumulation atop the tool, which plagues typically wireline tools preventing solid wireline, or wireline tools from traveling down into the well.

The preferred apparatus of the present invention includes a carrying tool for supporting or attaching hollowed internally bored wireline tools to a coil tubing unit comprising a length of coil tubing wound upon a reel. The apparatus further comprises an elongated carrying body, having a flow bore for circulating fluid through the tool, which communicates with an opening on the upper end of the tool so that one end of the length of the coil tubing unit can enter the bore. A connection within the bore forms a connection between one end of the coil tubing in the tool body, and includes a load transfer surface that is spaced along the tube bore, and a corresponding length of coil tubing end that occupies the tube bore. A wireline tool carrying means and/or means for carrying the shifting sub is formed on the lower end portion of the carrying body or alternatively the carrying body and connection to the coil tubing may be formed of a piece with the shifting sub for direct connection of the shifting sub to the end of the coil tubing. The shifting sub apparatus, if not contiguous with the carrier, includes a connection means for attachment to the tool carrier or carrying body, and further comprises, in a preferred embodiment, a cylindrical elongated body provided with a hollowed interior bore, and a piston member situated within said hollowed internal bore, which is releasably fixed in a retracted position. Means are provided to build up fluid pressure within the hollowed internal bore, and when a pre-selected pressure is reached, the piston apparatus is released, and suddenly and forcefully moves in a downward direction for a predetermined distance. The sudden or impulsive force is useful for shearing connecting pins which are a commonly used connecting device used to secure downhole flow control devices to locating and locking tools, as described previously. Rigidly connected to the internal piston member is a stem or rod which can be of any length desired, which in turn is connected to a connection means which allows interconnection of the piston to any tool, or shifting tool, for which a sudden forceful downward force may be required o desired.

The apparatus just described, comprising the shifting sub in combination with a carrying unit for attachment to a coil tubing unit, can also be run with an improved and modified pony structure provided with an extended hydraulic lift for raising the entire injector head. The shifting sub in combination with the extended lift pony structure enables dispensing with wireline equipment (for removing a safety valve, etc.). In this instance the modified pony structure is erected over the well and the injector assembly for the coil tubing unit is positioned on top of the pony structure. .The coil tubing unit with the shifting sub is run down the well, activated to actuate the shifting sub, which releases the safety valve and unlatches it from the well. The coil tubing unit with the attached safety valve is then withdrawn from the well and pulled up to the surface. When this unit reaches the surface, hydraulic or fluid pressure from the coil tubing unit is then supplied to the hydraulics attached to the pony structure which raise the entire injector assembly to a height above the valve on top of the well so as to raise the safety valve clear of the well above the valve enabling crew members to remove the safety valve and shifting tool from the end of the coil tubing unit. Depending upon the operations to be performed down in the well, the desired sub or device is then attached to the coil tubing unit which with its entire ejector assembly is lowered back into place by reversing the hydraulics on the extended modified pony structure, then the coil tubing unit is run into the well to continue operations. In this instance the combination carrying tool, shifting sub, and modified pony structure can completely dispense with the need for a wireline tool, while at the same time providing a much greater safety factor during operations around the well due to the minimization of the time work is being done without a safety valve in place, and without any tools in the well.

The apparatus, as described, can "run" many varied tools and equipment, including tools referred to as wireline tools which may or may not have been bored to allow fluid circulation, such as jars, accelerators, off/on overshots, jar pulling tools, and related fishing or wireline tools, including packing tools and safety valve setting and retrieving tools, and the present apparatus and method allow a greater and more precise downward impulsive forceful action than conventional coil tubing and wireline methods, and several thousand pounds of greater pulling strength than a wireline.

BRIEF DESCRIPTION OF THE DRAWINGS

The foregoing features and other below described aspects of the invention will be explained in greater detail when the following description is read and taken in conjunction with the accompanying drawings, wherein.

DETAILED DESCRIPTION OF THE PREFERRED EMBODIMENT

With reference now to the drawings, the new and improved method and apparatus presented by the present invention will now be described.

Figure 1:
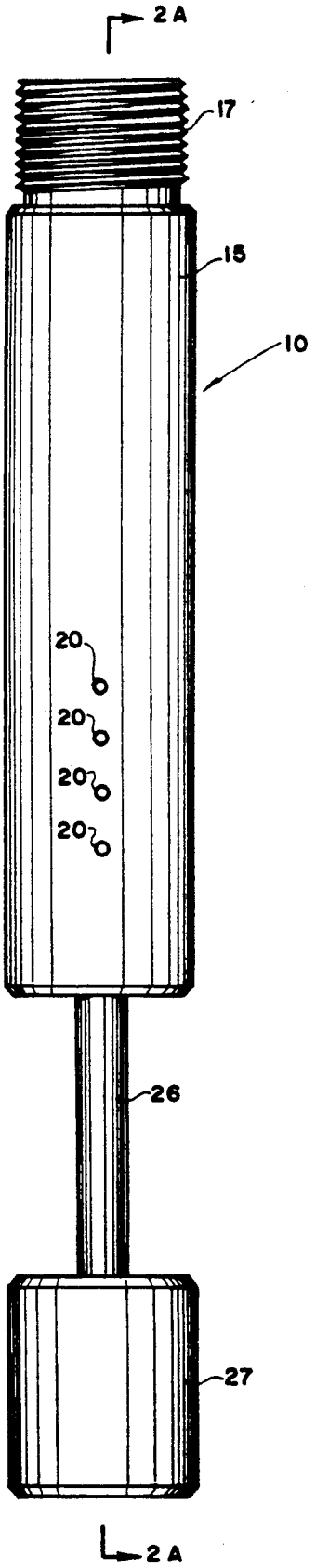
FIG. 1 is an elevational view which illustrates the shifting sub with extended piston.
Figure 2A:
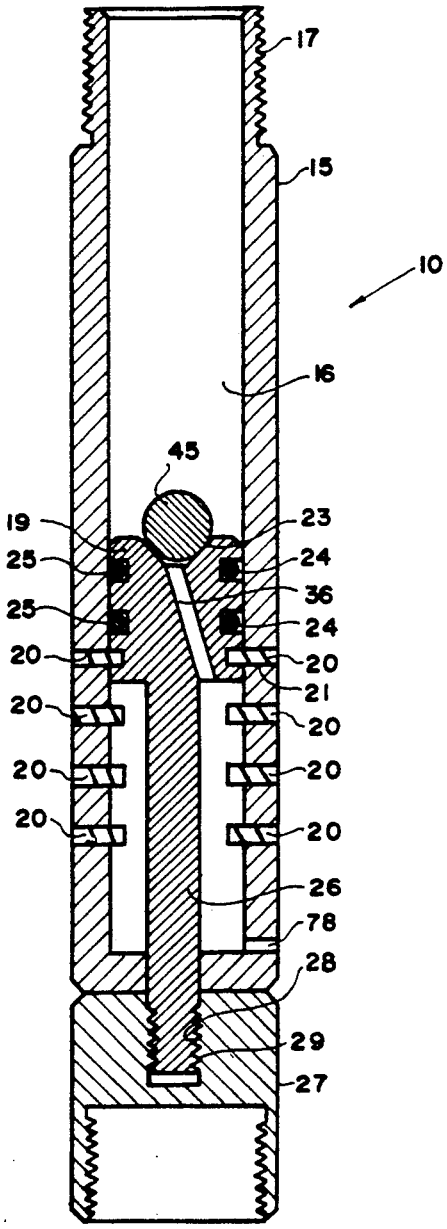
FIG. 2A is a sectional elevational view which represents the shifting sub ready to run.
Figure 2B:
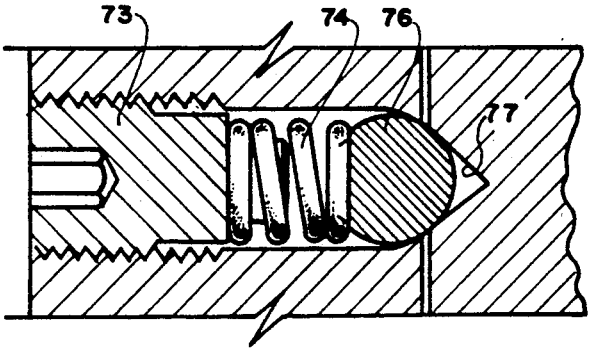
FIG. 2B is a blow up of a portion of FIG. 14.
Figure 3:
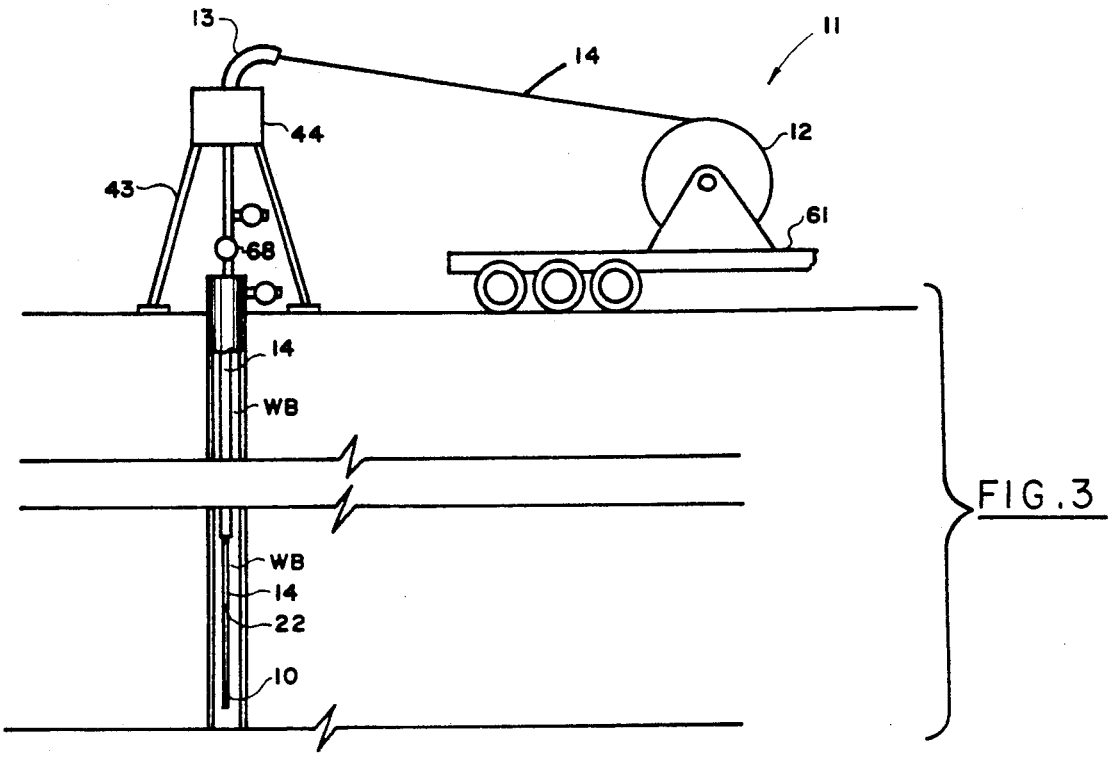
FIG. 3 is an elevational schematic view of the preferred embodiment of the apparatus of the present invention illustrating also the coil tubing unit, well bore and carrying body during use.

FIGS. 1 through 3 indicate the preferred embodiment of the apparatus of the present invention (designated generally by the numeral 10), and its use with a coil tubing unit.

Figure 4:
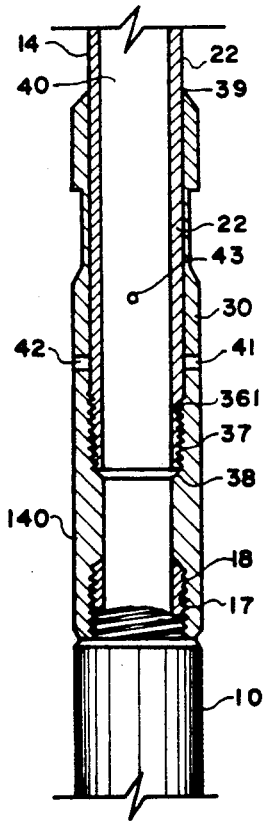
FIG. 4 is a sectional elevational view of the carrying body connecting a shifting sub to the lower end portion of a coil tubing unit and coil tubing string.
Figure 5:
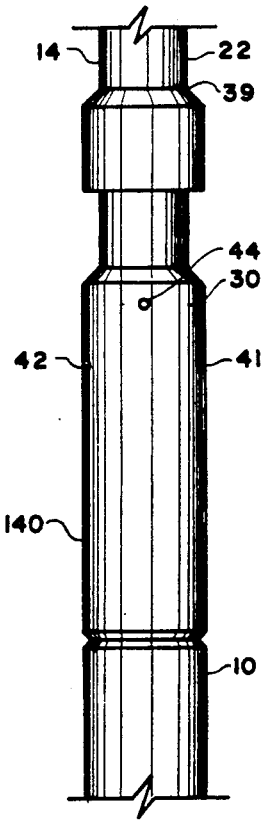
FIG. 5 is an elevational view of the tool carrier apparatus of the present invention.
Figure 7:
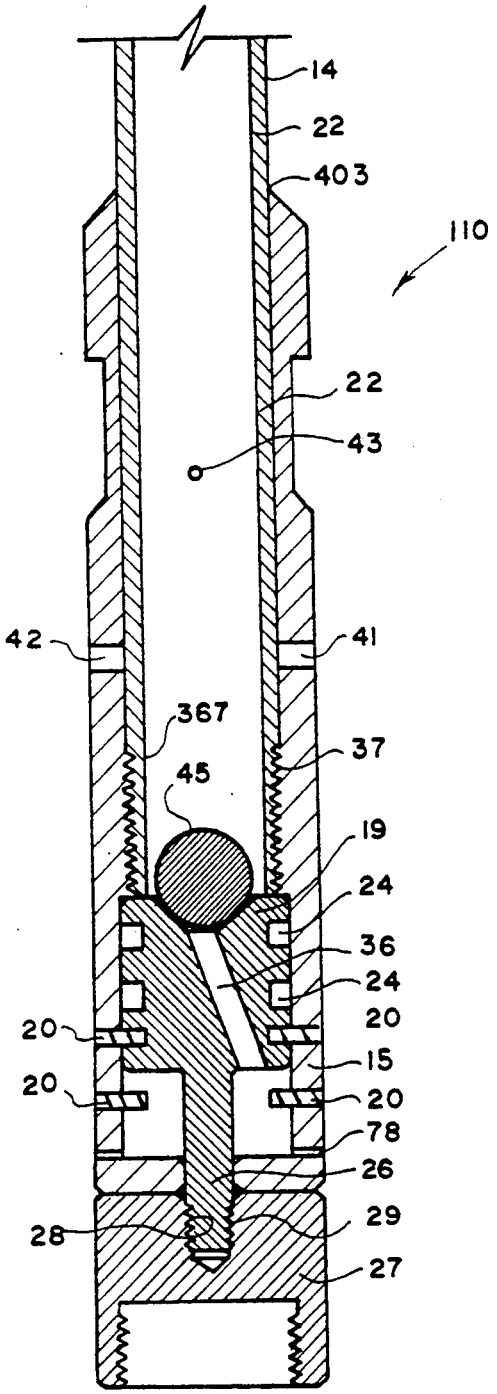
FIG. 7 is a cross-sectional view of the shifting sub of the present invention formed contiguously with a carrying means.

In FIG. 3 there can be seen a coil tubing unit 11 that includes a reel 12 having a length of coil tubing 14 wound upon the reel and skid mounted for use on land or offshore. An injector head 13 forces the tubing 14 into the well bore. WB. FIG. 3 generally indicates a carrier for reel 12. The reel 12 is supported by a foundation mounted upon the top of a bed 61. Tubing 14 can be run into a well bore WB, such as shown and described in Daniel U.S. Pat. No. 3,401,749, Smith et al., U.S. Pat. No. 3,791,447, and Smith et al., U.S. Pat. No. 3,722,594 each of which is incorporated herein by reference. The lowermost, or distal end portion 22 is attached to carrying tool or body 30. The connection of carrying body 30, and the lowermost end portion 22 of the tubing string, are best illustrated in FIGS. 4, 5 and 7.

In general, the method and apparatus for attachment of a tool carrying unit to a coil tubing string is set out in Crawford U.S. Pat. No(s). 4,612,984, and 4,682,657, both of which are incorporated herein by reference. The lowermost or distal end portion 22 of tubing string 14 attaches to carrying tool 30. The connection of carrying tool 30 and the lowermost 22 end portion of tubing string 14 is best seen in FIGS. 3 and 4. The end 22 portion of tubing string 14 provides a plurality of outer threads 361, which form a threaded connection with a corresponding set of female threads 37 upon tool carrier 30. Tool carrier 30 provides an uppermost open bore which is occupied by the end portion 22 of coil tubing 14 between 38 and 39 as indicated in FIG. 4. The uppermost portion of carrier 30 thus provides an open, generally cylindrical bore 40 which is occupied by the end portion 22 of tubing 14 between positions 38 and 39. The bore 40 is of an internal diameter substantially equal to the outside diameter of tubing string 14. When threads 361, 37 are threadably engaged, a plurality of set screws 41 through 44 can be tightened to form a further structural attachment between tubing string 14 and tool carrier 30. The lowermost end portion of tool carrier 30, designated as 140 in the drawings, provides another threaded section 18 having female threads which can engage the threads 17 of sub 10. This arrangement allows the running of a plurality of diverse hollow internally bored tools such as wire-line type tools, such as for example, jars, fishing tools, pulling tools, running tools, and/or off/on overshots. Other tools include a catch and releasable spear, a catch and releasable overshot, and/or numerous drills which can be supported from subs for example, or directly by the carrying tool.

Figure 8:
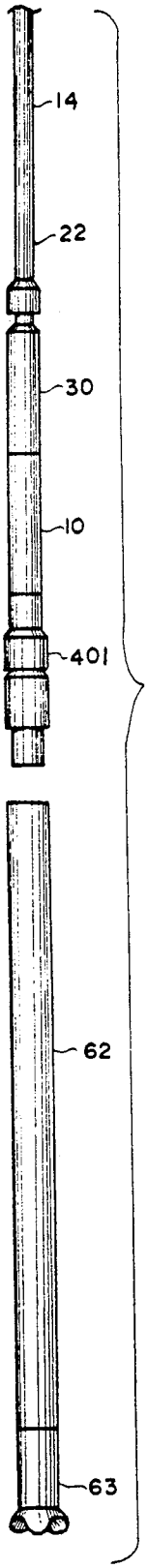
FIG. 8 is an elevational view of the apparatus of the present invention illustrating an assembly of coil tubing, carrying tool, shifting sub and a drill.
Figure 9:
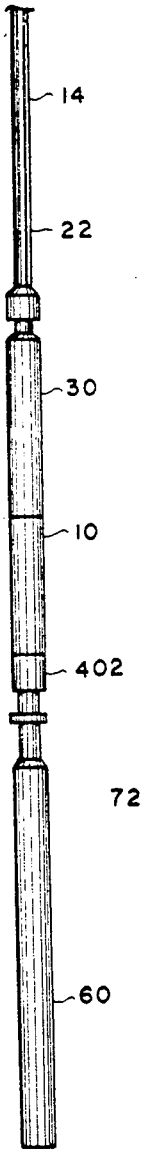
FIG. 9 is an elevational view of the apparatus of the present invention showing an assembly of coil tubing string, a carrying tool, and the shifting sub as used with a pulling tool or an off/on overshot.

FIGS. 8–11 illustrate a number of exemplary uses of the shifting sub as part of the overall embodiment of the apparatus of the present invention. In FIG. 8 there can be seen the lower 22 distal end portion of coil tubing string 14 attached to carrying tool 30 which in turn is attached to the shifting sub 10. The lowermost end portion of the shifting sub 10 is attached to a sub 401, which provides a one inch NPTX thread for supporting an elongated drill 62 (such as a down hole motor such as manufactured by DynaDrill) having a bit 63. In FIG. 9, coil tubing string 14 supports at its lower end 22 carrying tool 30 and shifting sub 10 to which is attached sub 402 and a wire-line tool which has been bored to allow fluid flow therethrough, such as for example an on/off overshot 60 such as manufactured by Baker Oil Tools but modified with a fluid circulating internal bore.

Figure 10:
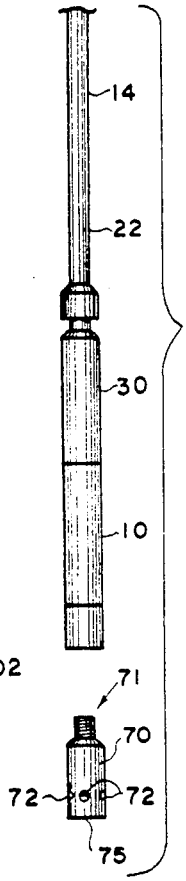
FIG. 10 is an elevational view of the apparatus of the present invention showing an assembly of coil tubing string, a carrying tool, the shifting sub, and a ported circulation sub.

In FIG. 10, carrying tool 30 is connected to shifting sub 10, in turn connected to a sub 70 having a plurality of radially spaced ports 72 which communicate with an internal bore of the sub 70. The sub 70 has an upper set of threads 71 which threadably attach to the shifting sub 10. Use of sub 70 allow circulation when running wire-line tools which do not have a hollow internal bore allowing circulation to a position adjacent the wire-line tool being run so that the circulating fluid can wash away debris in the well bore from the position of discharge of fluid through ports 72 and adjacent the wire-line tool assembly attached to sub 70. Thus, any wire-line tool can be connected by means of, for example female threads at the lower portion 75 of sub 70 and on the internal bore thereof. The sub 70 allows any wire-line tools (even those without a flow bore) to be run in the hole on the coil tubing string 14 in connection and combination with the shifting sub 10.

Figure 11:
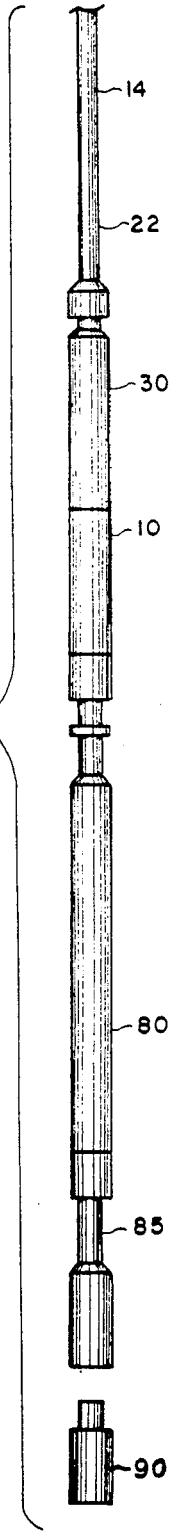
FIG. 11 is an elevational view of the apparatus of the present invention illustrating an assembly of the coil tubing string, a carrying connection, the shifting sub, and a jar end accelerator.

FIG. 11 illustrates the use of a jar and accelerator assembly 80 as run in the well with a shifting sub 10 by means of carrying tool 30 supported on coil tubing string 14. The lowermost portion of jar and accelerator assembly 80 is attached to an off/on releasable overshot 85 which can be from a attachment to any tool 90 which is lost in the well and must be retrieved. Such jars and accelerators are manufactured under the trademark "Taylor-Jar." Another tool assembly that can be run with this method is a releasable spear.

Referring to FIG. 1 and FIG. 2A, the shifting sub 10 comprises an elongated cylindrical housing 15 provided with a hollow interior bore 16. At the upper end of the housing is formed a means of connection 17 to the carrying body 30. In this illustrated embodiment, the carrying body 30 is provided with a threaded box connection 18 (See FIG. 4) for threaded connection to a threaded pin connection 17 on the shifting sub 10. This means of threaded interconnection between the tool carrier 30 and the shifting sub 10 is best seen in FIG. 4, although it is to be understood that alternate equivalent connection arrangements suggest themselves to those of skill in the art.

As earlier described the mans of connection to the lower end portion 22 of the tubing string may alternatively be formed of a piece with the upper portion of the shifting sub. This alternative embodiment is illustrated in FIG. 7. FIG. 7 shows a combination carrier body and shifting unit 110, where the upper portion comprises a cylindrical bore 403 for receiving the lower, end 22 of a coil tubing string 14. The end 22 is threaded at 367 for connection to internal threads 37, and sets screws 41–44 which can be tightened to form a further connection to the coil tubing 14. The lower portion comprises components of a shifting sub as will be described below.

Referring again now to FIGS. 1 and 2A additional components that comprise the shifting sub 10 include a piston element 19 and one or more threaded set screws 20 which are threadedly inserted through corresponding set screw holes 21 provided at the lower end of the shifting sub housing 10. When the set screws 20 are inserted through the set screw holes 21 through the housing, they protrude into the interior hollow bore 16 of the shifting sub as illustrated best in FIG. 2, and thereby retain the piston 19 in a contracted position as illustrated.

FIG. 2 additionally illustrates a setting ball 45, which can be assembled in the unit before attachment to the coil tubing or which can be inserted from the surface and dropped through the coil tubing unit to rest in a ball seat 3, fashioned at the uppermost surface of the piston 19. One or more fluid apertures 36 are provided in the seat and at the lower end of the tool as indicated at 78 to allow fluid circulation unless the apertures 36 are blocked by the setting ball. One or more o-ring seals 24 circling the piston 19 and placed within grooves 25 fashioned around the circumference of the piston 19 are provided to insure a fluid-tight seal between the piston and the interior of the sub 10, thereby allowing the needed pressure buildup to actuate the piston 19 by shearing the set screws 20. Alternatively as in FIG. 2B, the set screws 73 or other means can be used to hold a set of spring 74 loaded detent 77 balls 76 in position, and when sufficient pressure is generated to overcome the springs 74, the piston would be released in a manner similar to that when the set screws or pins 20 are sheared.

As can be seen in FIG. 2A, a series of set screws 20 extending down the length of the interior of the shifting sub 10 can be utilized. FIG. 2A illustrates four pairs of set screws. It is to be understood that there are equivalents to the set screws such as shearing pins and that other arrangements than pairing set screws can be used. Using a series of set screws or shear pins would provide a means of generating a series of downward shifting forces. The use of shear pins is well understood and well documented and regulated in the industry. Advantages of using a series of shear pins like this is that the precise amount of force necessary to shear a pin of a particular series can easily be calculated. Once this force is known, the operator of the coil tubing unit simply has to drop the ball dow the coil unit to come to rest in the ball seat blocking the fluid flow and building pressure. It is then a simple matter to watch the gauge as the pressure builds up and to control and provide the exact amount of pressure needed to shear the first set of pins in the series. Shear pins come in "series", designated by the manufacturer by the force required to shear the pin. Examples are pins that shear at 500, 1,000, 2,000, and 3,000 psi, although the range is not to be considered as so limited.

By utilizing pins that shear at a given pressure, and by selecting the number of pins to be used, the operator can also precisely determine the stroke of the shifting sub. A precisely controlled stroke is of great benefit in setting the safety valves, guaranteeing the valve is correctly and positively set, in contrast to the "Spang" jar method of setting a safety valve which amounts to little more than guess work.

The arrangement of the present invention provides clear advantages over anything else to be found in the art. The stroke can be precisely calculated by the location of the pins. The force can be also similarly calculated by selecting a number or given strength for the pins. In addition, a shifting sub constructed in this method can easily be removed from the hole and overhauled or modified to change the stroke or shearing force, unlike anything else in the art which has to be completely disassembled and overhauled to vary stroke or impact. Examples of other devices used in the field which must be disassembled for modification are those manufactured by Hipp which use a combination of hydraulics and preset and preloaded interior springs to provide a "jar" of indeterminate strength and stroke.

The pressure buildup required to actuate the piston 19 can be precisely controlled by selecting the number and diameter of the set screws 20 and by selecting the material the screws are formed from. Alternatively, where spring loaded detents are used, the set screws and interchangeable springs which may be of different stiffnesses can be used to adjust the tension, and varying numbers of detents can also be used to predetermine the pressure required to actuate the piston 19 into impulsive "downward" movement.

Formed integrally with, or alternatively connected to, the piston head 19 is a piston stem 26. The length of this stem may be varied depending upon the requirements of the tools or equipment the shifting sub is being utilized with. The downward impulsive movement of any tool or device attached to the stem 26 thus may be carefully predetermined, and further, the impact force of any such tool or device against a flow control device, downhole tool, or obstruction in the well bore can additionally be adjusted and predetermined by varying the length of piston travel prior to impact. Attached to the lower end of the piston rod 26 can be any type of tool or shifting tool, or connection, for example the box connection 27, as illustrated in FIGS. 1 and 2. The connection between the lower portion of the piston rod 26 and the box connection tool 27 may be by a threaded pin 28 and box 29 attachment means or equivalent as is illustrated in FIGS. 1 and 2A. The box 27 may sit flush with the lower end of the sub 10 when the piston 19 is in a fully retracted position (FIG. 2A.)

A representative illustrative example of the shifting sub 10 would be machined out of tool steel, the overall length in the run position, as in FIG. 2A, would be fifteen inches (15") the outside diameter would be one and three quarters inches ($1\frac{3}{4}$") and the overall length in the open position, as illustrated in FIG. 1, would be seventeen and a quarter inches ($17\frac{1}{4}$"). These dimensions are given for illustrative purposes only, and are not to be considered as limitations. In the representative example of FIG. 2A, two elastomeric o-rings seals 24 are used. One to six one quarter inch ($\frac{1}{4}$") set screws (or pins) 20 are provided, each of which is formed of an appropriate material to require an application of six hundred pounds (600 lbs.) of force, prior to shearing. The size of the shifting sub can be varied in all respects, depending upon the application, without exceeding the scope of the inventive concept of the present invention.

Figure 6:
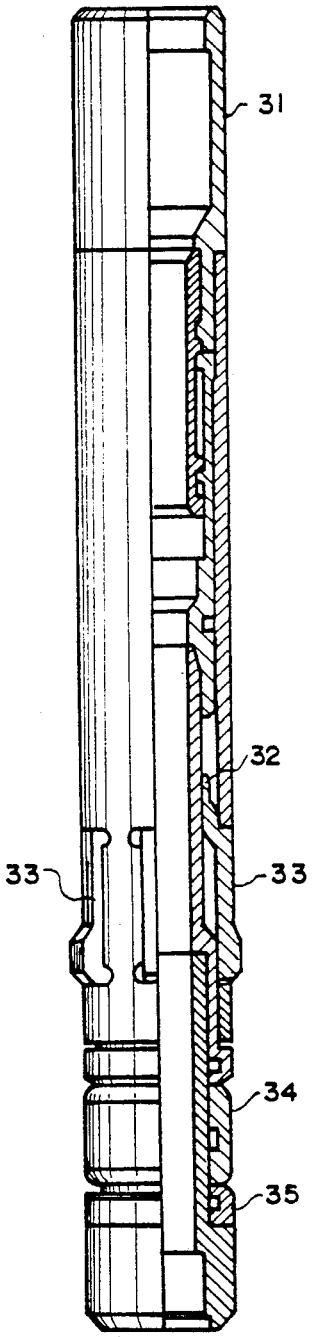
FIG. 6 is an elevational half sectional view which illustrates a downhole collar lock mandrel for use as a component of a variety of sub surface flow controls.

Referring now to FIG. 4, there is illustrated the connection of the shifting sub 10 to a coil tubing string 14 by means of a coil tubing tool carrier 30. FIG. 6 illustrates a typical collar lock mandrel as known in the art, which can be equipped to function with a variety of sub surface flow controls, for instance tubing safety valves, bottom hole regulators, packing tools, bridge plugs, bottom hole chokes, or other related downhole installations. Important features of the tool illustrated in FIG. 6 which apply to a variety of other tools such as safety valves, are as follows: a fishing neck 31; locking mandrel 32; locking dogs 33; expanding element 34; and, element expander 35. The fishing neck is provided for retrieving the tool illustrated in FIG. 6 by means that are well known in the art. The locking mandrel 32 and locking dogs 33 may be variously configured to conform to the desired well profile or internal nipple landing, also commonly understood in the art. The expanding element 34 and expander 35 are the means by which the tool illustrated in FIG. 6, which may be equipped as or with a safety valve, can be sealingly secured and left positioned within the well. A more specific description of the use of the shifting sub with tools of the general type as that illustrated in FIG. 6 will be forthcoming below.

Figure 12:
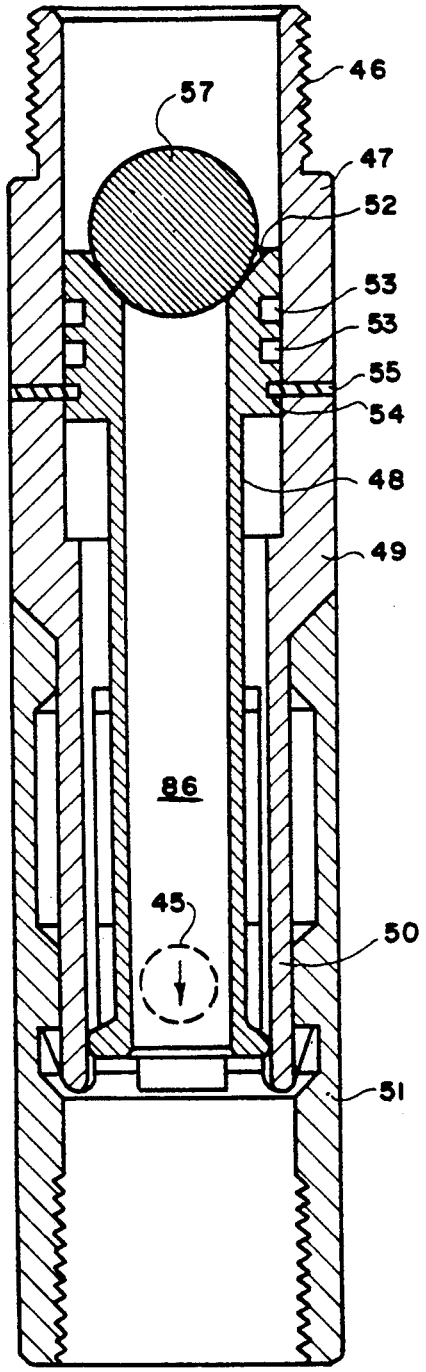
FIG. 12 is an illustration of a hydraulic release for use with the present invention.
Figure 13:
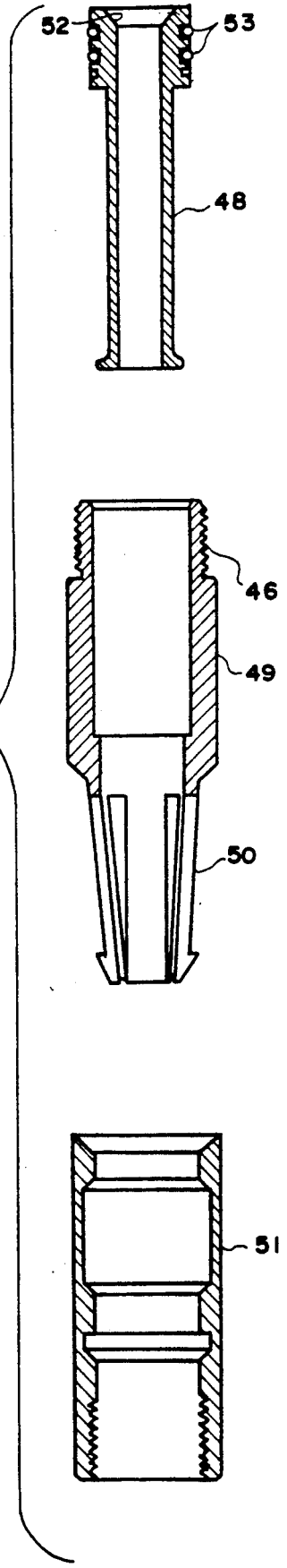
FIG. 13 is an exploded view of a hydraulic release.

FIGS. 12 and 13 illustrate a typical hydraulic release such as that known in the art which may be run in combination with the shifting sub 10 of the present invention as will now be described. Elements making up the hydraulic sub as illustrated in FIG. 12 are a threaded connection means 46 for connection to a carrier 30 as previously described. Within the body of the tool 47 are the hydraulic release mandrel 48 which rides within the hydraulic release top section 49 and can be actuated as will be described to allow the collapsible collet 50 to compress and release the top 49 from the bottom section 51. The hydraulic release mandrel 48 is provided with a ball seat 52, sealing o-ring grooves 53 and retaining set screws grooves in a manner similar to that described for the shifting sub. As with the shifting sub, a setting ball 57 may be introduced through the coil tubing string to drop down and rest within in the ball seat 52 and as the hydraulic release sub is pressured up the retaining set screws 55 will be sheared and drive the mandrel down collapsing the collet and releasing the bottom section of the hydraulic release from the top section and coil tubing string which can then be withdrawn from the well. In this manner, when the hydraulic release is interposed in the coil tubing string of the present invention between the shifting sub and the coil tubing string by dropping the setting ball of the appropriate size to rest in the valve seat 52 to actuate the hydraulic release, the shifting sub, and any attached equipment below the hydraulic release and the tubing string can be released from the tubing string and can be left within the well. This might be desirable in the case of a hydraulic release affixed to a fishing or setting tool which has become wedged or jammed within the well where the upper portion of the tubing string must be released and pulled from the well. As FIG. 12 illustrates, the hydraulic release sub has a bore or fluid passage 86 completely through the sub although it has appropriate connections at its upper and lower ends for connection to various components within the coil tubing string. Because of the fluid passage completely through the hydraulic sub, the shifting sub and its setting ball 45 can be configured so that the setting ball 45 is sized to slip through the fluid passage 86 through the hydraulic release and in such a manner the shifting sub can be pressured and actuated without releasing the hydraulic release. The setting ball 57 provided to actuate the hydraulic release must therefore be of a different and larger size than the setting ball 45 for use with the shifting sub when the two units are running the described combination.

Figure 15:
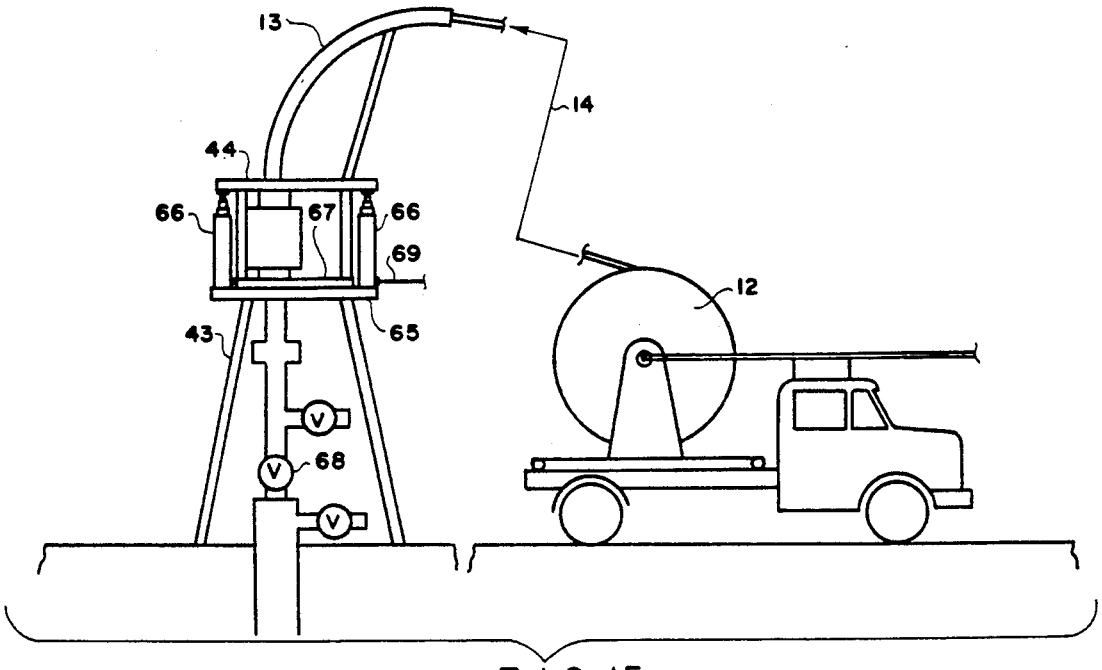
FIG. 15 is an elevation of a modified hydraulic pony structure and injector head.
Figure 16:
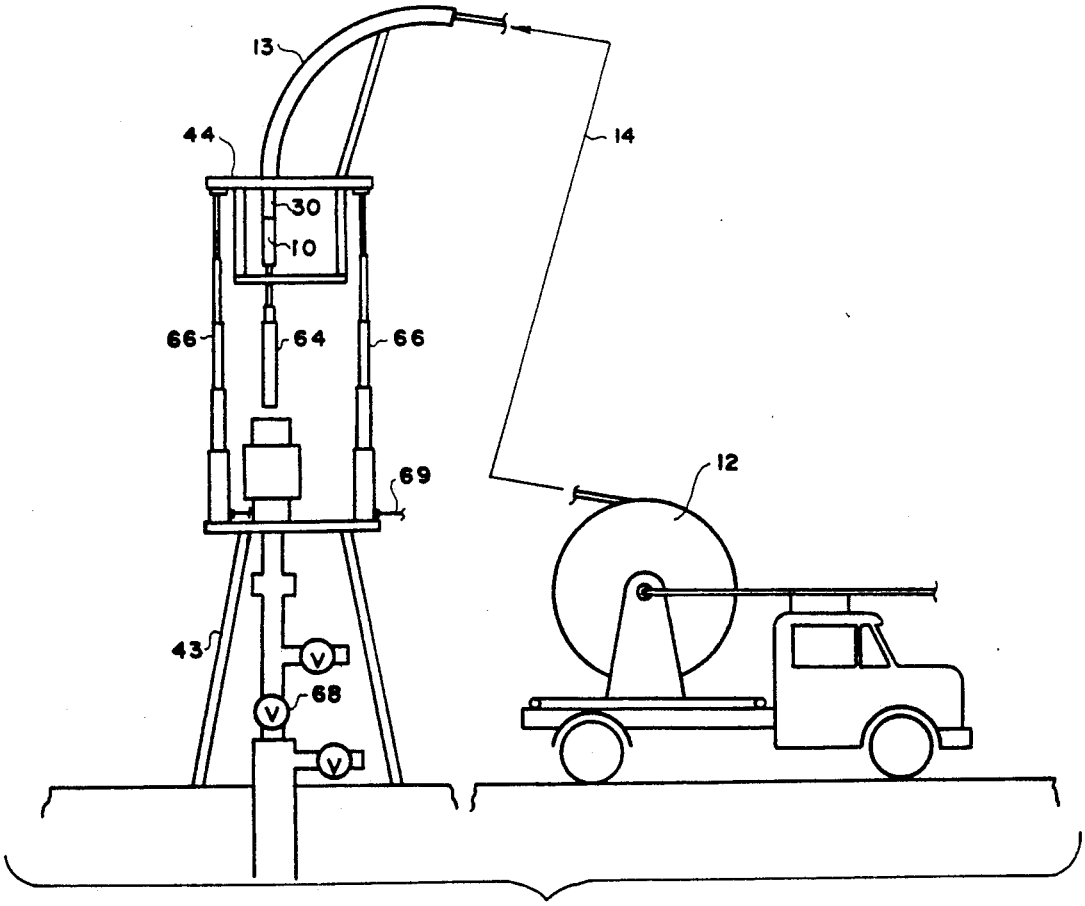
FIG. 16 is an elevation of the extended hydraulic pony structure.

FIGS. 15 and 16 illustrate additional enhanced safety aspects made possible by the use of the method and apparatus of the present invention. FIG. 15 illustrates the reel 12 carrying coil tubing 14 which has been mounted on a truck rather than on a trailer bed as in FIG. 3. FIG. 15 also illustrates the injector assembly or injector head 13 which has been set up over a sub structure 43 upon which rests a hydraulic extending pony 44 which provides the direct support for the injector head 13. Also seen in FIG. 15 are the hydraulic cylinder 66 and hydraulic jacks 65. The purpose of this arrangement will be made more clear by referring now to FIG. 16. FIG. 16 shows the same components just described as illustrated in FIG. 15, however in FIG. 16 the injector head 13 has been disconnected from the well head and the hydraulic jacks 65 have been actuated by supplying hydraulic pressure through line 69 in order to extend the cylinder 66. This raises the injector head 13 and extending pony structure 44 to a height above the sub structure 43 to so as to allow crew members to remove a safety valve 64 from the end of the shifting sub 10. It should be readily appreciated that there are alternative equipment arrangements utilized at different well heads. The spirit of this facet of the present invention is to provide a self sufficient means of raising the injector head 13 above the working floor 67 of the sub structure. In some work environments this could be done by interposing the hydraulic jacks between the pony structure and the decking of ship or drilling platform. Providing the hydraulic extending pony structure for us in combination with the improved carrying tool and shifting sub of the present invention enhances the safety of the working environment for the crew men by minimizing time spent working over a hole without a safety valve in place as will be described in further detail below. In addition, providing the self contained hydraulics which can be operated by the existing equipment provided with the coil tubing unit further equipment and man power savings are realized because a standby crane is no longer necessary.

Method of Use of the Present Invention

As mentioned above, the problem with prior art coil tubing devices is that it is impossible to apply a downward force to set and/or remove many of the common types of well sub surface flow control devices. Wireline equipment, in contrast, can be utilized to furnish such a sudden downward impulsive force, but wireline equipment exhibits problems of its own, examples being limited tensile capabilities, and therefore limited ability to furnish upward pulling forces. In addition, the solid wireline tools are subject to becoming hung up by sand bridging in the well, precisely one of the uses coil tubing was developed to remedy. Therefore, in the present art, well service operations must have both the wireline and coil tubing unit, or both the wireline and work over unit and crew on standby during service operations. By utilizing the above described apparatus in the following described manner, great savings in time and materials can be utilized, because only a coil tubing unit will be required for well servicing, since by using the apparatus of the present invention and method to be described below, all types of subsurface well flow control devices, including devices that require a downward forceful impulse for setting or removal, can be installed, run, and removed.

In one representative use of the shifting sub, the tool carrier 30 is connected to the distal portion 22 of a coil tubing unit 14 which is run from a coil reel 12 through an injection header 13, as illustrated in FIG. 3. The tool carrier 30 is connected to the distal portion 22 of the tubing string 14, as illustrated in FIG. 4, by means of the threaded connections 361 provided at the distal portion of the tubing unit, and at the interior of the tubing carrier 37, and by means of set screws 41–44 as is described in the incorporated references, U.S. Pat. No(s). 4,612,984, and 4,682,657.

As illustrated in FIG. 4, the distal portion of the carrying body 30 is provided with a threaded box connector 18, to which is threadedly attached the threaded pin connector 17 of the shifting sub 10. Before running, the shifting sub in the collapsed position as illustrated in FIG. 2A is provided with one or more pins 20, which are selected so that the hydraulic pressure required to actuate the piston and shear the pins is precisely known, enabling the coil tubing unit service operator to calculate the shearing force available, and therefore supply the correct force in a downward direction, and thereby install or remove sub surface well flow control equipment as desired.

For example, to set a safety valve which requires a downward force release, the safety valve is connected in the manner known in the art to a locating locking tool or mandrel such as illustrated in FIG. 6 which in turn would be affixed to the connection 27 at the distal portion of the shifting sub tool 10. The shifting sub, in the running position as illustrated in FIG. 2A, with the attached safety valve and setting tool such as illustrated in FIG. 6 (or similar) would then be run into the well, and because of the presence of correctly shaped spring-loaded locking dogs 33, would locate and preliminarily latch itself into correct position within a nipple of the proper profile, when the proper location is reached. At this point by pulling upward on the assembly, a great upward tensile force can achieved with the coil tubing unit, and the proper setting tool, as for instance in FIG. 6, the expander 35 would be pulled in the upward direction causing the expanding element 34 to circumferentially expand and thereby lock and wedge the safety valve (or other well sub surface flow control unit) into position. For a unit that requires such an upward force to seat, a downward force is required to shear retaining pins and release the setting tool, which is threadedly attached to the shifting sub, from the safety valve (sub surface flow control element) which can then be left in the well as the coil tubing string is retrieved. To provide the downward force, a setting ball 45 is dropped down the coil tubing string 14 from the surface, into the shifting sub, where it comes to rest on the ball seat 23 provided in the upward portion of the piston 19. As the ball sets in this seat it restricts the apertures 36, that previously permitted fluid flow through the coil tubing string, and through both the tool carrier 30, and the shifting sub 10. With the apertures restricted, applying ever increasing amounts of fluid pressure through the tubing string 14 causes a pressure build up within the shifting sub interior bore 16. When this pressure build up reaches a predetermined point, which as previously mentioned can be precisely determined by varying the number of set screws 20 and/or their composition number, and diameter, the piston 19 will be suddenly and forcefully driven past the set screw openings 21 and any setting or shifting tool, or box connection 27, attached to the lower portion of the piston rod 26, will be suddenly and forcefully moved across the shear pin, shearing the pin, and thereby releasing the coil tubing unit, tool carrier, and shifting sub and impulse tool from the sub surface well flow control device. Normal hydraulic working pressures are in the range of one thousand (1,000) psi to five thousand (5,000) psi, but much higher pressure can be achieved if desired.

The shear force piston rod 26 can be of any length desired. When the equipment to be installed or retrieved is a safety valve, as just described above, the representative embodiment of a shifting sub which was previously described, with a piston rod of approximately two and three-quarters inches ($2\frac{3}{4}''$) in length would be appropriate. For other types of equipment, as for instance for working with packing subs, a relatively longer piston rod could be used, for example, to knock packers out of the bottom of the hole.

Figure 14:
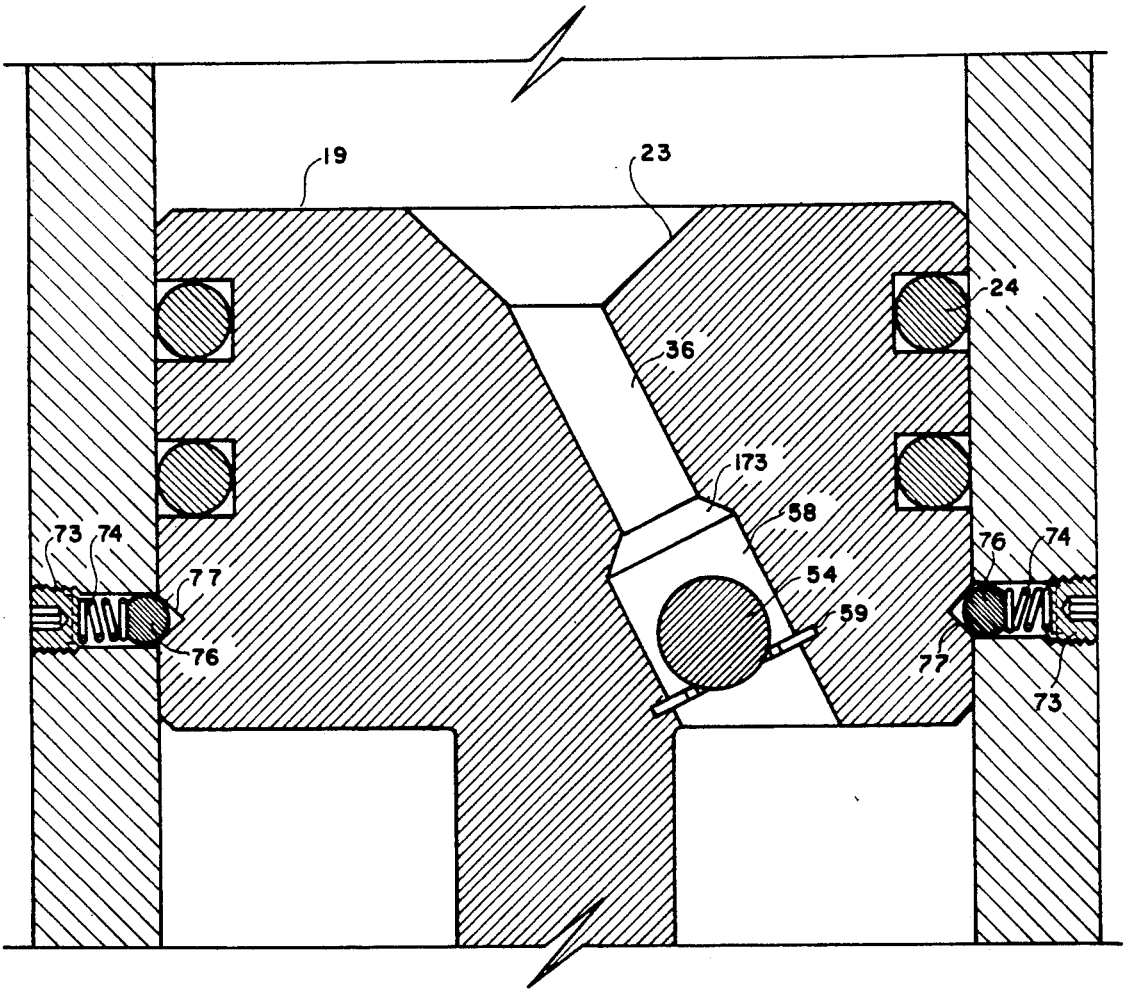
FIG. 14 is a partial cross-sectional view of the shifting sub of the present invention illustrating a venting hydraulic re-cocking mechanism.

The previously described embodiment has specifically been described as applying a single downward stroke, (occurring at the shearing of a set of pins). By providing a series of pins, a series of strokes can be achieved without re-cocking. An alternative embodiment of the present invention can also be provided which would enable the operator to re-cock the piston of the shifting sub, and thereby enable the operator to apply repeated forceful downward impacts where that may be desired. One alternative embodiment that would allow a repeated application of downward forceful impacts with the shifting sub, would provide a spring loaded mechanical re-cocking means, or as illustrated in FIG. 14 a hydraulic venting re-cocking means. As illustrated in FIG. 14, the shifting sub piston fluid aperture 36 is provided with an expanded chamber 58, the lower portion of which is fashioned to accept a retaining clip 59 which holds a ball 54 in place. When pressure outside the tool 10, in the well bore, exceeds that inside the hollow coil tubing the ball 54 will be forced up the expanded chamber 58 and will seat against a ball seat 173 near the upper part of chamber 58. By lowering fluid pressure within the coil tubing, or pulling a vacuum there, the differential fluid pressure of a mud column in the well bore could be utilized to re-cock or reset the shifting sub. Similarly, well pressure or other means could be used. These methods would provide a sudden forceful downward impulse movement as the detents are overcome, required for shearing a pin, and subsequent to that would provide a slower upward re-cocking movement, in order that subsequent downward shearing forces could be applied if so desired.

Various other arrangements could be provided to control the application of the shear force movements downhole, for example, fluid pulse transmission patterns to open and shut selective valves, or other telemetry methods could be used to signal a variety of types of downhole trigger or re-cocking devices.

A particular and important use of the present invention will be in the situation where the coil tubing is being used to remove or install a safety valve. The importance of installing a safety valve downhole has been mentioned several times previously. Referring now to FIGS. 15 and 16, and taking the instance where the coil tubing operation is going to be started at the beginning of a day with the safety valve already in place, the coil tubing string 14 is run off the reel and through the injector head 13 and after opening valve 68 is forced down the well bore. The coil tubing string is provided with a tool carrier 30 and the shifting sub 10, to which has been installed a mandrel configured for interconnection with a safety valve 64. The coil tubing string with attached mandrel is run down and connected to the safety valve and is then pulled upward with a force sufficient to release the safety valve and retrieve it from the well. Once the safety valve has been pulled up above valve 68, valve 68 is closed. Thereafter hydraulic force is supplied through line 69 to the hydraulic jacks 65 which raise the telescoping cylinders 66, which in turn raise the pony structure 44 to a height above the working floor 67 sufficient to allow crewmen to remove the safety valve 64 from the end of the coil tubing string. Thereafter the hydraulics are reversed and the telescoping cylinders 66 are lowered until the pony structure 44 is again at its collapsed position as illustrated in FIG. 15. The injector head assembly is again secured to the top of the wellhead, valve 68 is opened and the coil tubing string is run back into the well to begin the day's coil tubing operations.

At the end of the coil tubing service operations, the string is pulled out of the well bore, valve 68 is closed, the upper portion of the well head is vented and the injector head assembly is disconnected from the well head. The hydraulics are again activated to raise the pony structure and clear the end of the coil tubing string. Whatever tool was in use is removed from the string, the shifting sub with a safety valve and setting mandrel is connected and positioned in the upper portion of the well head by lowering the pony structure and reconnecting the injector head to the well head. Valve 68 is then opened and the safety valve/shifting tool/coil tubing is forced down the well bore by the injector assembly.

When the correct profile is reached the safety valve is properly located. The shifting sub is then actuated by dropping a setting ball into the ball seat and building up pressure within the shifting sub tool body. The shifting sub releases, positively and precisely locking the safety valve in position and the coil tubing string is pulled upward to release the setting mandrel and shifting sub from the safety valve. The tubing string is then completely removed from the well, leaving the safety valve in place. No wireline operations are needed, consequently no time and no extra equipment are needed to convert from coil tubing to wireline operations. The conversion in many cases must be done without a safety valve in place because prior to the present invention some safety valves could not be set by coil tubing units and in many cases some could not be removed by wireline units. This apparatus and method significantly reduces the time for conducting operations over a well without a safety valve in place, and therefore significantly improves the safety of operations.

With respect to the above description, it is to be realized that the optimum dimensional relationships for the parts of the invention are to include variations in size, materials, shape, form, function and manner of operation, assembly and use, and are deemed readily apparent to one skilled in the art, and all equivalent relationships to those illustrated in the drawings encompassed in the specification, are intended to be encompassed by the present invention.

Therefore, the foregoing is considered as illustrative of the principals of the invention, exemplifying any kind of method and apparatus for the application of an impulsive downward shearing force from a coil tubing well service unit. Further, since numerous modifications will readily occur to those skilled in the art, it is not desired to limit the invention to the exact construction and operation shown or described, and all suitable modifications and equivalents may be resorted to, falling within the scope of the invention.

What is claimed as being new, and desired to be protected by United States Letters Patents is a follows:

1. A method for running tools in an oil/gas well on coil tubing comprising:

(a) running an elongated coil tubing string, initially positioned on a reel, down an oil/gas well through an injector head forming a tubing work string;

(b) securing a selective fluid conveying tool, comprising a tool body having an open flow bore and lower connection means movable with respect to the tool body, to the distal end of the coil tubing string, so that fluid can be selectively circulated from the coil tubing on the reel, through the open flow bore and into the tool, the tool body having an upper portion, a lower portion, and a bottom end; and (c) equipping said tool with force means for providing a sudden downward forceful movement at said lower connection means, relative to the tool body, the force means comprising:

(i) a piston disposed within the flow bore within the tool body, the piston having an upper surface, the piston having an aperture therethrough allowing continuous fluid circulation through the coil tubing, the upper portion of the tool body, the piston, and out through an aperture in the lower portion of the tool body;

(ii) a ball seat provided in the upper surface of the piston;

(iii) retaining means for releasably retaining the piston within the upper portion of the tool flow bore;

(iv) the piston comprising a piston rod having a first and second ends and being connected to the lower part of a piston head at its first end, the piston rod being provided at its second end with connection means protruding past the bottom end of the tool body, for connection to other tools; and (v) a setting ball for introduction into the tubing and thereafter into the tool flow bore for fitting into the ball seat at the top of the piston, and for covering the fluid aperture through the piston to restrict the fluid flow through the tool body, and thereby cause a pressure build-up within the tool body sufficient to release the retaining means, to actuate the piston to forcefully move downward upon the release of the retaining means.

2. The method of claim 1, further comprising:

(d) introducing pressurized gas into the well through the flow bore of the tubing so that it circulates through the tubing and then through the connected selective fluid conveying tool; and (e) supporting a tool assembly so that tension can be applied for operation of a second tool supported by the string using pressure applied to the tool assembly and fluid conveying tool through the tubing work string.

3. The method of claim 2, wherein:

the second tool is a wireline tool modified to allow fluid circulation.

4. The method of claim 1, wherein:

the tool includes mechanical means operable by tension applied through the coil tubing for forming a connection with an object that has become temporarily lost in the well.

5. The method of claim 2, wherein:

the coil tubing string is thrust into the well by rotation of the reel in connection with operation of the injector head.

6. The method of claim 2, wherein:

the second tool is an overshot.

7. The method of claim 1, further comprising the step of:

applying a force to the tubing string by the injector head to move the tubing string and tool through the well.

8. The method of claim 2, further comprising the step of:

simultaneously pumping pressurized fluid from the coil tubing through all tools that aid in moving through material accumulated in the well.

9. The method of claim 2, wherein: the second tool is a jar.

10. A method of carrying wireline tools, fishing, running, or setting well service tools, or equipment with a coil tubing unit, comprising the steps of:

(a) running a coil tubing string from a coil tubing unit down an oil/gas well through an injector head;

(b) securing a tool adapted for selective flow of fluid to the distal end of the coil tubing string so that fluid can circulate from the coil tubing string through the tool, until selectively obstructed;

(c) adapting said tool to include force means to provide a sudden forceful downward shearing force, relative to the coil tubing string, upon a pressure build up resulting from the obstruction of the fluid flow; and (d) adapting said tool at its lower end for connection to a sub-surface well device which requires application of a sudden downward shearing force to run, set, or release the sub-surface well device, the force means comprising:

(i) a piston disposed within a flow bore within the tool, the piston having an upper surface, the piston having an aperture therethrough allowing continuous fluid circulation through the coil tubing, the upper portion of the tool, the piston, and out through an aperture in the lower portion of the tool;

(ii) a ball seat provided in the upper surface of the piston;

(iii) retaining means for releasably retaining the piston within the upper portion of the tool flow bore;

(iv) the piston comprising a piston rod having first and second ends and being connected to the lower part of a piston head at its first end, the piston rod being provided at its second end with connection means protruding past the bottom end of the tool, for connection to the subsurface well device; and (v) a setting ball for introduction into the tubing and thereafter into the tool flow bore for fitting into the ball seat at the top of the piston, and for covering the fluid aperture through the piston to restrict the fluid flow through the tool, and thereby cause a pressure build-up within the tool sufficient to release the retaining means, to actuate the piston to forcefully move downward upon the release of the retaining means.

11. The method of claim 10, wherein:

said tool is adapted at its lower end for connection to a bridge plug having a basket.

12. The method of claim 11 comprising the additional steps of running the bridge plug to a selected location in the well bore, setting the bridge plug in place and expanding the basket of the bridge plug and then depositing bridging material on top of the basket by pumping said bridging material through said coil tubing.

13. The method of claim 10 further comprising adapting a perforation gun for connection to the lower end of said tool and further adapting said perforation gun to fire in response to an impulse generated by said tool.

14. A method for running tools in an oil/gas well on coil tubing comprising:

(a) running an elongated coil tubing string, initially positioned on a reel, down an oil gas well through an injector head forming a work string;

(b) mounting said injector head on an extending sub platform interposed between a base and said injection head;

(c) securing a selective fluid conveying tool comprising a tool body having an open flow bore and lower connection means movable with respect to the tool body, to the distal end of the coil tubing string, so that fluid can be selectively circulated from the coil tubing on the reel, through the open flow bore and into the well through the tool, the tool body having an upper portion, a lower portion, and a bottom end; and (d) equipping said tool with force means for providing a sudden downward forceful movement of said lower connection means relative to said tool body, the force means comprising:

(i) a piston disposed within the flow bore within the tool body, the piston having an upper surface, the piston having an aperture therethrough allowing continuous fluid circulation through the coil tubing, the upper portion of the tool body, the piston, and out through an aperture in the lower portion of the tool body;

(ii) a ball seat provided in the upper surface of the piston;

(iii) retaining means for releasably retaining the piston within the upper portion of the tool flow bore;

(iv) the piston comprising a piston rod having first and second ends and being connected to the lower part of a piston head at its first end, the piston rod being provided at its second end with connection means protruding past the bottom end of the tool body, for connection to other tools; and (v) a setting ball for introduction into the tubing and thereafter into the tool flow bore for fitting into the ball seat at the top of the piston, and for covering the fluid aperture through the piston to restrict the fluid flow through the tool body, and thereby cause a pressure build-up within the tool body sufficient to release the retaining means, to actuate the piston to forcefully move downward upon the release of the retaining means.

15. A method for installing and removing safety valves in well bores off of coil tubing comprising:

(a) setting an injector head of a coil tubing unit on a vertically extendable substructure above a well head;

(b) running an elongated tubing string, initially positioned on a reel, through an injector head down an oil/gas well forming a work string;

(c) securing a selectively fluid conveying tool, comprising a tool body having an open flow bore and lower connection means movable with respect to the tool body, to the distal end of the coil tubing string, so that fluid can be selectively circulated form the coil tubing on the reel and then through the open flow bore and into the tool, the tool body having an upper portion, a lower portion, and a bottom end;

(d) equipping said tool with force means for providing sudden downward forceful movement of said lower connection means relative to said tool body;

(e) affixing a safety valve carrying mandrel to said lower connection means of said tool body;

(f) extending the vertically extendable support platform above the well head to raise said injector head, said tool and said safety valve carrying mandrel above the well head and clear of the well head for engaging and disengaging the safety valve during installation and removal procedures; and (g) collapsing said vertically extendable support platform so as to lower said injector head assembly over the well head so as to run said tool and said safety valve carrying mandrel into said well bore for safety valve installation and removal procedures, the force means comprising:

(i) a piston disposed within the flow bore within the tool body, the piston having an upper surface, the piston having an aperture therethrough allowing continuous fluid circulation through the coil tubing, the upper portion of the tool body, the piston, and out through an aperture in the lower portion of the tool body;

(ii) a ball seat provided in the upper surface of the piston;

(iii) retaining means for releasably retaining the piston within the upper portion of the tool flow bore;

(iv) the piston comprising a piston rod having first and second ends and being connected to the lower part of a piston head at its first end, the piston rod being provided at its second end with connection means protruding past the bottom end of the tool body, for connection to the safety valve carrying mandrel; and (v) a setting ball for introduction into the tubing and thereafter into the tool flow bore for fitting into the ball seat at the top of the piston, and for covering the fluid aperture through the piston to restrict the fluid flow through the tool body, and thereby cause a pressure build-up within the tool body sufficient to release the retaining means, to actuate the piston to forcefully move downward upon the release of the retaining means.

* * * * *